United States Patent [19]

Okamori

[11] Patent Number: 4,661,003

[45] Date of Patent: Apr. 28, 1987

[54] BIDIRECTIONAL COLOR PRINTING APPARATUS

[75] Inventor: Shuhei Okamori, Nagoya, Japan

[73] Assignee: Brother Kogyo Kabushiki Kaisha, Aichi, Japan

[21] Appl. No.: 758,323

[22] Filed: Jul. 24, 1985

[30] Foreign Application Priority Data

Jul. 27, 1984 [JP] Japan ..... 59-158114

[51] Int. Cl.[4] ..... B41J 3/44; B41J 35/14; B41J 35/16

[52] U.S. Cl. ..... 400/216.1; 400/82; 400/224

[58] Field of Search ..... 400/212, 216, 216.1, 400/216.2, 216.3, 216.4, 216.5, 216.6, 224, 239, 240, 240.3, 240.4, 82, 207, 208, 208.1, 323

[56] References Cited

U.S. PATENT DOCUMENTS

| | | | |
|---|---|---|---|
| 4,003,460 | 1/1977 | Gray et al. | 400/212 |
| 4,403,874 | 9/1983 | Payne et al. | 400/82 X |
| 4,426,168 | 1/1984 | Jozuka et al. | 400/224 |
| 4,528,576 | 7/1985 | Koumura et al. | 346/75 X |
| 4,543,001 | 9/1985 | Tanaka et al. | 400/216.1 X |

FOREIGN PATENT DOCUMENTS 53-4616 1/1978 Japan .

*Primary Examiner*—Charles A. Pearson
*Attorney, Agent, or Firm*—Parkhurst & Oliff

[57] ABSTRACT

A color printer for effecting impression of images on a paper bidirectionally along a print line, using plural bi-color ribbons or a single multi-color ribbon, so as to provide plural color portions of different colors. The printer comprises plural print head units corresponding to the plural color portions of the ribbon or ribbons, and support and feed devices for supporting the paper, ribbon or ribbons and the print head units, such that the color portions of the ribbon or ribbons in opposed relation with the print head units are spaced from each other along the print line and arranged in order of brightness of the colors thereof in selected one of the opposite printing directions along the print line. An assembly of the ribbon or ribbons and the print head units is moved along the print line relative to the paper. A switching device is provided to reverse the order of brightness of the color portions of the ribbon or ribbons when the printing direction is reversed, to maintain the order of brightness in the currently selected printing direction.

7 Claims, 7 Drawing Figures

BIDIRECTIONAL COLOR PRINTING APPARATUS

BACKGROUND OF THE INVENTION

1. Field of the Art

The present invention relates to a color printing apparatus capable of printing in different colors, and more particularly to a bidirectional color printer of impact type for impression of clear images using an inked ribbon or ribbons.

2. Related Art Statement

In the art of color printing with inks of different colors, it is a generally recognized requirement to use inks in order of brightness or lightness of their colors, i.e., to effect printing in light colors prior to printing in dark colors, in order to assure clear color printing.

A serial-impact multi-color printing apparatus is known according to U.S. Pat. No. 4,426,168 to Jozuka et al owned by the assignee of the present application. This printer uses a multi-color ribbon having plural transversely spaced longitudinal color portions or stripes of different colors of different values of brightness, and a print head assembly including plural print wire units which are arranged along the print line. The multi-color ribbon accommodated in a ribbon cassette is skewed relative to the print line so that the individual color stripes are fed in opposed relation with the rows of print wires of the corresponding print wire units. The plural color strips are arranged in order of brightness of their colors so that the brightness is increased in one of opposite printing directions along the print line (viz., from left to right). In this arrangement, the printing may be effected bidirectionally along a print line when images to be printed in different colors are spaced from each other. However, when it is desired to print in intermixed colors with overlapping dots of different colors, the color printing should preferably be made in only one of the opposite printing directions (from left to right) in which the brightness of the color stripes is increased. Namely, the printing in the other direction does not provide satisfactory printing results, because dots of relatively dark colors may be formed prior to dots of relatively light colors. Accordingly, the printing efficiency is sacrificed if it is desired to maintain a high level of print quality, or the print quality is sacrificed if it is desired to achieve a color printing at a high speed. Thus, the printer proposed in the above-identified patent is not satisfactory in terms of total performance of printing speed and quality.

Another type of multi-color printer is known according to Japanese Patent Application No. 51-77483 laid open Jan. 17, 1978 under Publication No. 53-4616, wherein a multi-color ribbon similar to the ribbon indicated above is fed along the print line, and their different color stripes are selected by vertically shifting the exposed portion of the multi-color ribbon between a print head and a recording medium. To attain multi-color printing, the print head should be moved over a print line for each of the plural colors that are used for the line. Thus, the printer of this type requires an increased length of time for printing a line of images in different colors, and suffers considerably low color-printing efficiency.

SUMMARY OF THE INVENTION

It is therefore an object of the present invention to provide an improved color printer which is capable of bidirectional printing of images in a plurality of colors at a high speed without sacrificing print quality.

According to the invention, there is provided a color printer for effecting impression of images on a recording medium selectively in one of opposite printing directions along a print line, comprising: ribbon means having plural color portions of different colors having different values of brightness or lightness; a plurality of print head units corresponding to the plural color portions of the ribbon means, respectively, for transferring masses of inks or inking material from the respective color portions to the surface of the recording medium; support and feed means for supporting the recording medium, the ribbon means and the print head units, such that the color portions of the ribbon means in opposed relation with the print head units are arranged along the print line in order of brightness of the colors thereof in the selected one of the opposite printing directions, the support and feed means effecting a relative movement between an assembly of the ribbon means and the print head units, and said recording medium, in each of the opposite printing directions along the surface of the recording medium; and switching means, associated with the support and feed means, for reversing the order of brightness of the color portions of the ribbon means when the printing direction is changed from one of the opposite printing directions to the other, whereby the order of brightness is maintained in the currently selected printing direction.

The color printer of the invention constructed as described above is capable of effecting a bidirectional color printing operation in which printing actions using comparatively light colors precedes printing actions using comparatively dark colors, irrespective of the direction in which the printing of a line takes place. Hence, the instant color printer is satisfactory not only in the printing efficiency but also in the print quality.

According to one advantageous embodiment of the invention, the ribbon means comprises a multi-color ribbon having at least three transversely-spaced parallel longitudinal color stripes of different colors, and the support and feed means supporting the multi-color ribbon rotatably about an axis perpendicular to the print line, to provide a first position in which the multi-color ribbon is fed in a first direction intersecting the print line, and a second position angularly spaced from the first position and in which the multi-color ribbon is fed in a second direction intersecting the print line. The color stripes of the multi-color ribbon in the first position are disposed in opposed relation with the respective print head units such that the brightness of the color stripes is increased in one of the opposite printing directions. In the meantime, the color stripes of the multi-color ribbon in the second position are disposed in opposed relation with the respective print head units such that the brightness of the color stripes is decreased in the above-identified one of the opposite printing directions. In this case, the switching means comprises rotary drive means for rotating the multi-color ribbon to the first position when the said one printing direction is selected, and to the second position when the other printing direction is selected.

In the above embodiment of the color printer, the exposed part of the multi-color ribbon is rotated to the first or second position each time the printing direction is changed from one direction to the opposite direction. Thus, only a single multi-color ribbon is used commonly for the plural print head units, and the order of brightness of their color stripes in opposed relation with the print head units is reversed by means of rotation of the ribbon at its exposed part.

According to another advantageous embodiment of the invention, the ribbon means comprises at least three bi-color ribbons adapted to be fed between the corresponding print head units and the recording medium, each of the bi-color ribbons having two transversely-spaced parallel longitudinal color stripes, the two color stripes of the bi-color ribbons forming a first and a second array of at least three color portions along the print line so that the brightness of the color portions of the first array is increased in one of the opposite printing directions while the brightness of the color portions of the second array is decreased in this one printing direction. In this instance, the switching means comprises ribbon shift means for selectively positioning the color stripes of the first array into alignment with the print head units when the above-indicated one printing direction is selected, and positioning the color stripes of the second array into alignment with the print head units when the other printing direction is selected.

In the above embodiment, plural bi-color ribbons corresponding to the print head units are used, and the color stripes of the individual ribbons provide upper and lower arrays of different colors corresponding to the print head units. The order of brightness of the colors of the upper array is opposite to that of the lower array. These upper and lower, i.e., first and second color arrays are selectively brought into printing positions on the print line, depending upon the currently selected one of the opposite printing directions.

In one preferred form of the above embodiment, four bi-color ribbons are used, and their color stripes of the first array have ink layers of black, cyan, magenta and yellow in that order in the above-identified one printing direction, while the color stripes of the second array have ink layers of yellow, magenta, cyan and black which correspond to the ink layers of the first array.

In another preferred form of the above embodiment, the support and feed means comprises ribbon cassettes adapted to support the bi-color ribbons for feeding thereof between the corresponding print head units and the recording medium, respectively, and the ribbon shift means comprises carriers for supporting the ribbon cassettes pivotally about an axis parallel to the print line, and oscillator means for pivoting the carriers between a first position and a second position for selective alignment of the first and second arrays of color stripes with the print head untis. The carriers consist of a single common support member for supporting all of said ribbon cassettes. The oscillator means may include biasing means for biasing the carriers toward one of the first and second positions, and electromagnet means for rotating the carriers to the other of the first and second positions against a biasing force of the biasing means.

In a further preferred form of the same embodiment, the support and feed means comprises a carriage which carries the bi-color ribbons and the print head units, and drive means for moving the carriage in the opposite printing directions along the print line.

In accordance with a further advantageous embodiment of the invention, each of the print head units comprises a print head of wire-dot matrix type having a plurality of print wires to form dots within a matrix.

BRIEF DESCRIPTION OF THE DRAWINGS

The above and other objects, features and advantages of the present invention will be better understood from reading the following detailed description of preferred arrangements of a color printer embodying the concept of the invention, when considered in connection with the accompanying drawings, in which.

DETAILED DESCRIPTION OF THE PREFERRED EMBODIMENTS

Figure 1:
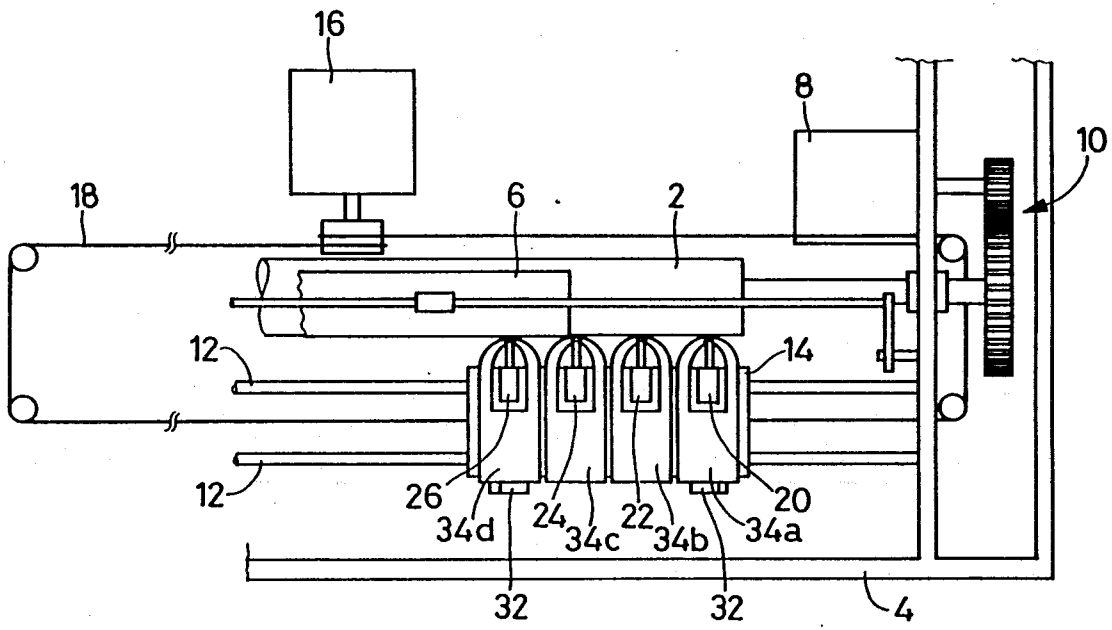
FIG. 1 is a schematic plan view of one embodiment of a color printer of the invention in the form of a serial-impact dot-matrix printer.

To further clarity the concept of the present invention, preferred embodiments of the invention will be described in detail, by reference to the accompanying drawings.

Referring first to FIGS. 1 through 4, there is shown a serial-impact color printer of dot-matrix type, wherein reference numeral 2 designates an elongate platen of cylindrical shape which is rotatably supported on a printer frame 4 to hold a recording medium in the form of a sheet of paper 6. The platen 2 is rotated by a paper feed motor 8 via a gear train 10 which connects the motor 8 and the platen 2. With the platen 2 rotated, the sheet of paper 6 is fed in a direction perpendicular to an axis of rotation of the platen 2, that is, in a direction perpendicular to a print line on the paper 6.

A pair of spaced-apart parallel guide rods 12 are secured to the printer frame 4 so as to extend parallel to the platen 2. The guide rods 12 support a carriage 14 so that the carriage 14 is slidably movable in opposite printing directions along the print line (along the platen 2) in opposed relation with the sheet of paper 6. The carriage 14 is reciprocated by a carriage drive stepper motor 16 located in front of the platen 2, via a drive wire 18 which transmits a rotary motion of the carriage drive motor 16 to the carriage 14.

The carriage 14 carries four dot-matrix print heads 20, 22, 24, 26 which are spaced from each other along the platen 2, and a cassette holder 28 (FIG. 2) behind the print heads 20, 22, 24, 26. The cassette holder 28 is supported at its opposite longitudinal ends by pivot pins 30 (only one pin shown) secured to the carriage 14, so that the holder 28 is pivotable about an axis parallel to the print line or platen 2. The cassette holder 28 is biased by suitable biasing means 29 in the clockwise direction (indicated at A in FIG. 2) whereby the holder 28 is normally held in its first position. Below the cassette holder 28, there are disposed two electromagnets 32, 32 which, when energized, generate magnetic forces of attraction to pivot the cassette holder 28 in the counter-clockwise direction (indicated at B in FIG. 2) against a biasing force of the biasing means. Thus, the cassette holder 28 is held in its second position by the energized electromagnets 32, 32. The cassette holder 28 supports four ribbon cassettes 34*a*, 34*b*, 34*c*, 34*d* which are formed and disposed so as to surround the print heads 20, 22, 24, 26, respectively, as most clearly shown in FIG. 2. The ribbon cassettes 34*a*, 34*b*, 34*c*, 34*d* accommodate bi-color ink ribbons 36*a*, 36*b*, 36*c*, 36*d*, respectively, such that the exposed part of each ink ribbon is fed between the appropriate print head and the sheet of paper 6. Each of the ink ribbons 36*a*, 36*b*, 36*c*, 36*d* has two transversely-spaced parallel longitudinal color stripes of different colors which are selected from among four colors: yellow Y, magenta M, cyan C and black B (the brightness of which is decreased in that order). Described more specifically with reference to FIG. 3, the bi-color ink ribbon 36*a* has an upper color stripe Y with a yellow ink layer (brightest color), and a lower color stripe B with a black ink layer (darkest color). The bi-color ink ribbon 36*b* has an upper color stripe M with a magenta ink layer (second brightest color) and a lower color stripe C with a cyan ink layer (second darkest color). The bi-color ink ribbon 36*c* has an upper color stripe C with a cyan ink layer and a lower color stripe M with a magenta ink layer. The bi-color ink ribbon 36*d* has an upper color stripe B with a black ink layer and a lower color stripe Y with a yellow ink layer.

Figure 2:
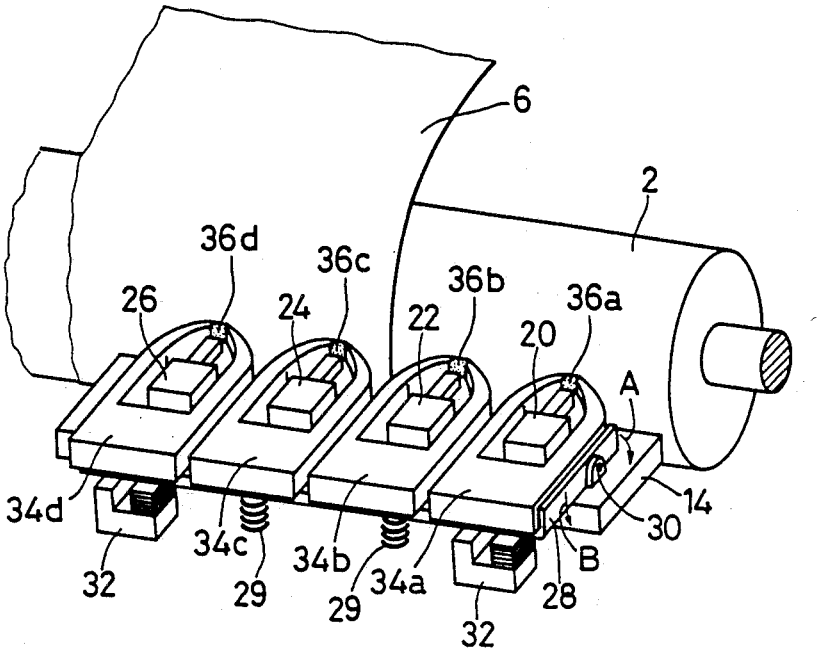
FIG. 2 is a perspective view illustrating an enlargement of print heads, ribbon cassettes and a platen of the dot-matrix color printer of FIG. 1.
Figure 3:
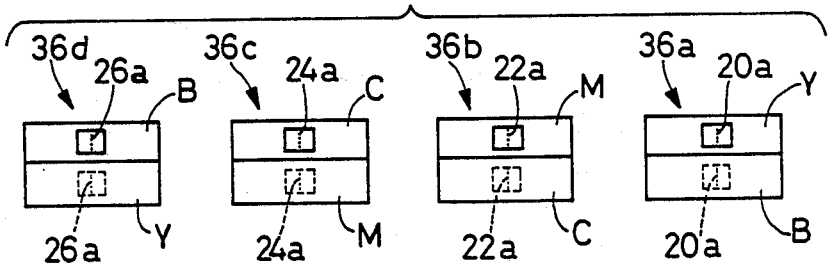
FIG. 3 is an illustration showing the positional relation of the print heads with respect to upper and lower color stripes of the corresponding bi-color ribbons.

As is apparent from FIG. 3, the upper color stripes Y, M, C and B of the four bi-color ink ribbons 36*a*, 36*b*, 36*c*, 36*d* form an upper or first array of four colors, yellow, magenta, cyan and black, and the lower color stripes B, C, M and Y of the ribbons 36*a*–36*d* form a lower or second array of the same four colors. It will be understood that the brightness of the color stripes of the upper array is increased from left to right (B-C-M-Y) in FIG. 2 (in one of opposite printing directions), while the brightness of the color stripes of the lower array is decreased in the same direction (Y-M-C-B). While the cassette holder 28 is held in its first position, namely, while the exposed parts of the bi-color ink ribbons 36*a*–36*d* are in their lower position, print wire rows 20*a*, 22*a*, 24*a*, 26*a* of the corresponding print heads 20, 22, 24, 26 are held in opposed relation with the color stripes Y, M, C, B of the upper or first array of the ink ribbons 36*a*, 36*b*, 36*c*, 36*d*, respectively, as indicated in solid lines in FIG. 3. This position is selected when the printing is effected in the right direction, so that the yellow color stripe Y (ink layer Y) leads the magenta color stripe M (ink layer M), which in turn leads the cyan color stripe C (ink layer C), which in turn leads the black color stripe B (ink layer B). When the printing is effected in the left direction, the electromagnets 32 are energized and the cassette holder 28 is brought into its second position in which the exposed parts of the ink ribbons 36*a*–36*d* are placed in their upper position. In this position, the print wire rows 20*a*, 22*a*, 24*a*, 26*a* of the print heads 20, 22, 24, 26 are opposed to the color stripes B, C, M, Y of the lower or second array of the ink ribbons 36*a*, 26*b*, 36*c*, 36*d*, respectively, as indicated in broken lines in FIG. 3.

Figure 4:
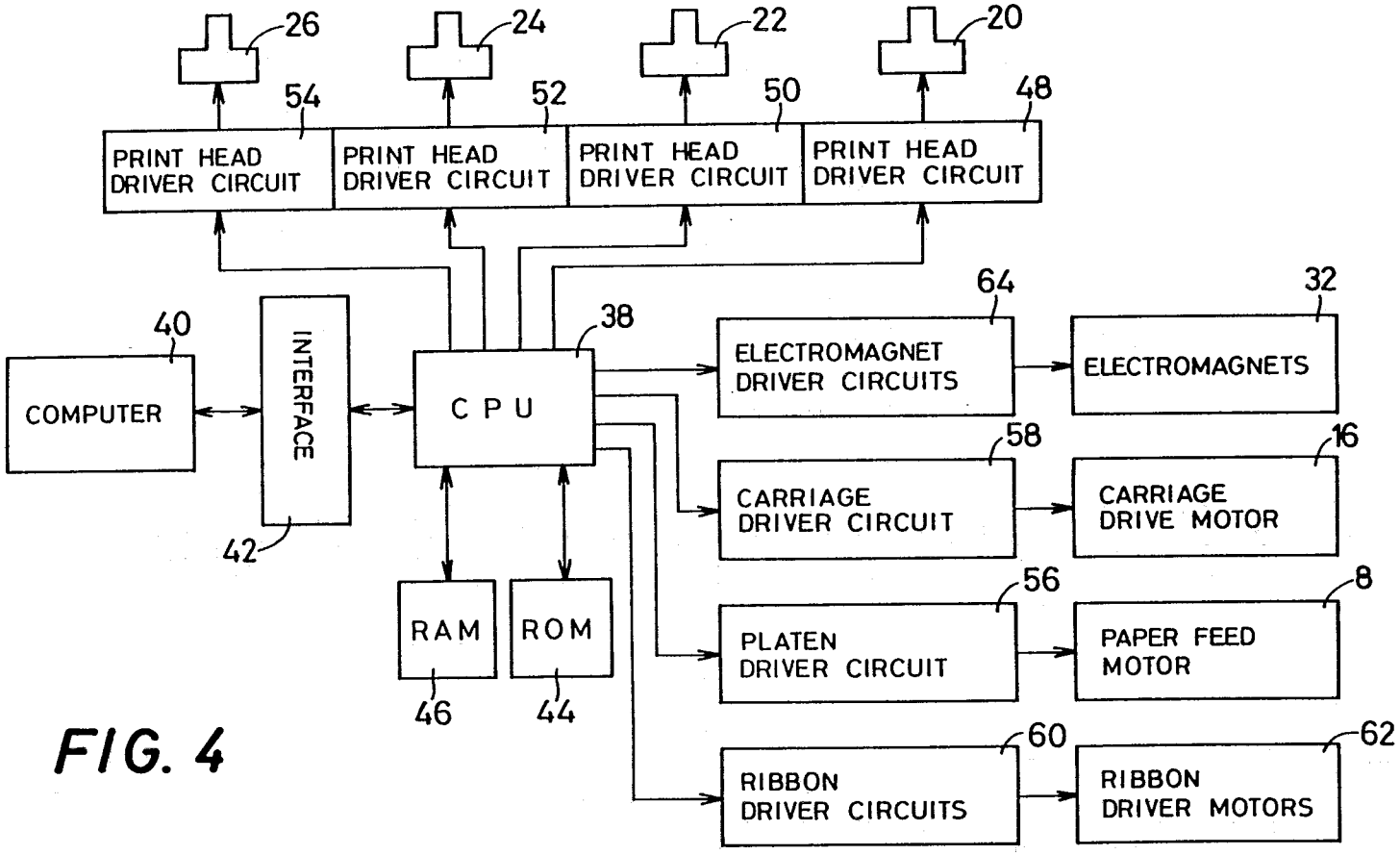
FIG. 4 is a block diagram of a control system of the dot-matrix printer of FIG. 1.

A control system of the color printer constructed as described hitherto is illustrated in FIG. 4, wherein a central processing unit 38 (hereinafter referred to as "CPU") is connected to a computer 40 via an interface 42 to receive printing and other signals. The CPU 38 operates according to programs stored in a read-only memory 44 (hereinafter referred to as "ROM"), while utilizing temporary data storage functions of a random-access memory (hereinafter called "RAM") 46. The CPU 38 controls: print head driver circuits 48, 50, 52 and 54 to activate the corresponding print heads 20, 22, 24 and 26; a platen driver circuit 56 to operate the paper feed drive motor 8; a carriage driver circuit 58 to operate the carriage drive motor 16; ribbon driver circuits 60 to operate ribbon drive motors 62; and electromagnet driver circuits 64 to energize the electromagnets 32.

The printing operations may be effected bidirectionally along the print line, i.e., from left to right, or from right to left, as seen in FIGS. 1 and 2. The printing operation in the right direction will be first described.

[PRINTING OPERATION IN RIGHT DIRECTION]

In a forward printing operating with the carriage 14 moved in the right direction, the print wire rows 20*a*, 22*a*, 24*a* and 26*a* of the print heads 20, 22, 24, 26 on the carriage 14 are opposed to the upper color stripes Y, M, C and B of the upper array of the ink ribbons 36*a*, 36*b*, 36*c*, 36*d*, respectively, as indicated in solid line in FIG. 3. In this condition, the CPU 38 receives from the computer 40 color print signals Y, M, C and B to form yellow, blue, red and black dots. The received color print signals Y, M, C and B are stored in the RAM 46, and are read out from the RAM 46 according to commands based on the program stored in the ROM 44, so that the color print signals Y, M, C, B are applied to the print head driver circuits 48, 50, 52 and 54, respectively. In response to the color print signals Y, M, C and B, the print head driver circuits 48, 50, 52, 54 are operated to activate the appropriate print wires of the print wire rows 20*a*, 22*a*, 24*a*, 26*a* of the print heads 20, 22, 24, 26, as the carriage 14 is moved step by step in the right direction with the carriage drive motor 16 being operated under control of the carriage driver circuit 58. As the ink ribbons 36*a*–36*d* are consumed, they are fed past the print wire rows 20*a*, 22*a*, 24*a*, 26*a* by the ribbon drive motors 62 under control of the ribbon driver circuits 60. Thus, a line of images may be printed in the selected colors with a single movement of the print heads 20, 22, 24, 26 to the right. Since the upper color stripes Y, M, C and B of the currently selected upper array of the ribbons 36*a*–36*d* are moved to the right in that order, the printing actions of the wire dots may take place in the order of yellow, magenta, cyan and black in the currently selected printing direction, that is, in the right direction.

[PRINTING OPERATION IN LEFT DIRECTION]

Upon completion of the color printing of the entire line in the right direction indicated above, the CPU receives from the computer 40 via the interface 42 a paper feed signal to operate the platen driver circuit 56 to activate the paper feed drive motor 8 to advance the sheet of paper 6 to the next line position. Further, in response to the paper feed signal, the CPU 38 operates the electromagnet driver circuits 64 to energize the electromagnets 32. Based on a command from the ROM 44, the CPU applies the ribbon shift signal to the electromagnet driver circuits 64 to energize the electromagnets 32, whereby the cassette holder 28 is attracted to the electromagnets 32 with their magnetic forces. As a result, the cassette holder 28 is pivoted about the pivot pins 30 in the counterclockwise direction B (in FIG. 2) and placed in its second position in which the color strips B, C, M, Y of the lower array of the ink ribbons 36*a*–36*d* are brought into alignment with the print wire rows 20*a*, 22*a*, 24*a* and 26*a* of the print heads, respectively, as indicated in broken line in FIG. 3. This second position of the cassette holder 28 is maintained until the new line has been printed. As in the printing of the preceding line in the right direction, the CPU 38 receives color print signals Y, M, C and B from the computer 40. The received color print signals are stored in the RAM 46, and are read out from the RAM 46 according to commands based on the program stored in the ROM 44. In this case, however, the color print signals Y, M, C, B are applied to the print head driver circuits 54, 52, 50, and 48, respectively. In response to the color print signals Y, M, C and B, the print head driver circuits 54, 52, 50, 48 are operated to activate the appropriate print wires of the print wire rows 26*a*, 24*a*, 22*a*, 20*a* of the print heads 26, 24, 22, 20, as the carriage 14 is moved step by step in the left direction. Thus, the printing of the line in question is accomplished while the printing actions of the wire dots take place in the order of yellow, magenta, cyan and black in the left direction. When the last image of the line has been printed, the electromagnets 32 are deenergized by the electromagnet driver circuits 64, and the cassette holder 28 is pivoted in the clockwise direction A (FIG. 2) by the biasing force of the biasing means previously indicated back to its first position. Consequently, the color stripes Y, M, C, B of the upper array of the ink ribbons 36*a*–36*d* are aligned with the corresponding print wire rows 20*a*, 22*a*, 24*a* and 26*a* of the print heads 20, 22, 24, 26.

As described hitherto, a desired number of successive lines of images may be printed in a continuous fashion with inks of the four colors while the carriage 14 is reciprocated alternately in the right and left directions.

In the instant embodiment, the four bi-color ink ribbons 36*a*–36*d* are used corresponding to the print heads 20, 22, 24 and 26. The bi-color ribbons 36*a*–36*d* are adapted so that their upper color stripes Y, M, C and B of the ribbons provide the first horizontal array of four colors, yellow, magenta, cyan and black from right to left, while their lower color stripes B, C, M and Y provide the second horizontal array of the same colors in the reverse order. The bi-color ribbons 36*a*–36*d* are vertically shifted by switching means in the form of the electromagnets 32, between their upper and lower positions, so that the color stripes Y, M, C and B of the first horizontal array are opposed to the print wire rows 20*a*, 22*a*, 24*a* and 26*a* of the print heads 20, 22, 24 and 26 when a line is to be printed in the right direction, and so that the color stripes B, C M and Y of the second horizontal array are opposed to the print head rows 20*a*, 22*a*, 24*a* and 26*a* when the line is to be printed in the left direction. In this arrangement, the four colors may be used in order of the brightness or lightness in the currently selected printing direction. Namely, the yellow dots may be formed prior to the dots of other colors, the magenta or blue dots prior to the red and black dots, and the red dots prior to the black dots. Thus, it is possible to prevent, for example, the yellow dots from being overwhelmed by the black dots, even if the dots are partially overlapped. In addition, the bidirectional printing contributes to an increase in the color printing speed. Although the instant embodiment uses four colors, the concept of the present invention may apply to a color printer which uses two or more different colors.

Figure 5:
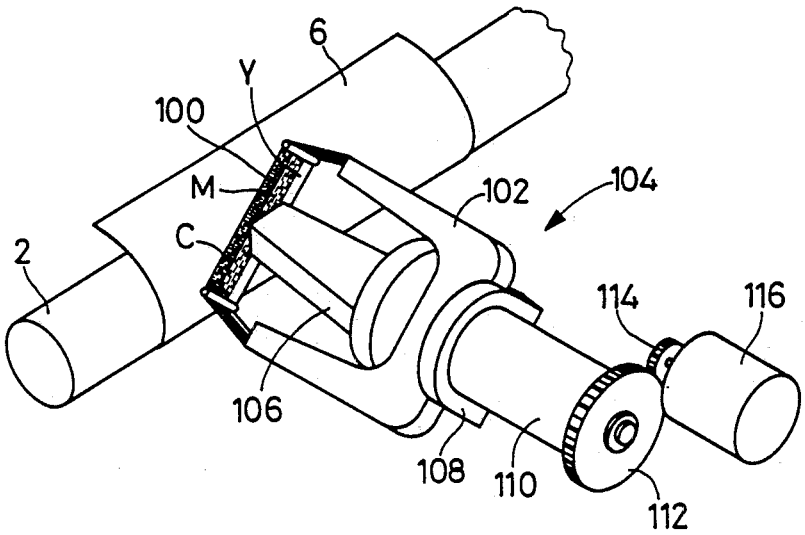
FIG. 5 is a fragmentary perspective view of another embodiment of the invention.
Figure 6:
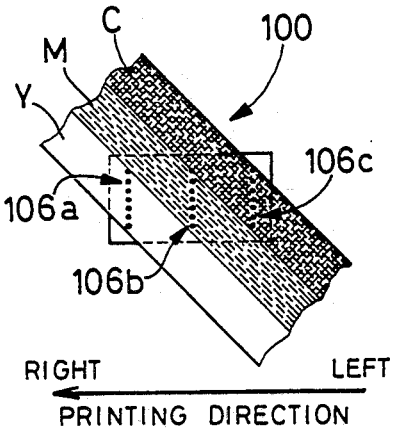
FIG. 6 is a schematic view showing the positional relation of a multi-color ribbon with respect to print heads in the embodiment of FIG. 5, while the ribbon is in its first position.
Figure 7:
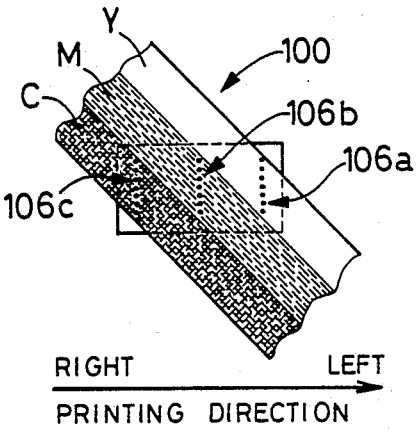
FIG. 7 is a schematic view showing the positional relation of the ribbon of FIG. 6 with respect to the print head while the ribbon is in its second position.

Referring next to FIGS. 5–7, a modified embodiment of the present invention will be described. In the interest of brevity and simplification, only those parts of the modified printer which differ from those of the preceding embodiment will be described.

This modified embodiment uses a single multi-color ink ribbon in the form of a three-color ribbon 100 which has three transversely-spaced, parallel longitudinal color stripes Y, M and C with yellow, magenta and cyan ink layers, respectively, as illustrated in FIG. 6 on an enlarged scale. The three-color ribbon 100 is accommodated in a ribbon cassette 102 which is removably mounted on a print head assembly 104, so that the ribbon 100 is fed between the operating end of the assembly 104 and the surface of the paper sheet 6.

More specifically, the print head assembly 104 comprises a print head 106, a bracket 108 secured to the print head 106, and a rotary support shaft 110 which is secured to the bracket 108 such that the support shaft 110 is co-axial with the print head 106. The print head 106 has three dot-matrix print head units having vertical print wire rows 106*a*, 106*b* and 106*c*, respectively, as indicated in FIG. 6. These print wire rows 106*a*–106*c* are spaced from each other along the platen 2. The ink ribbon 100 is positioned obliquely at a predetermined angle with respect to the print wire rows 106*a*–*106c* of the print head 106, such that the yellow, magenta and cyan stripes Y, M and C are held in opposed relation with the print wire rows 106*a*, 106*b* and 106*c* of the print head 106, respectively, as shown in FIG. 6.

The print head assembly 104 is mounted on a carriage similar to the carriage 14 of the preceding embodiment, by means of bearings (not shown) fitting on the rotary support shaft 110, such that the entire assembly 104 on the carriage is rotatable about an axis perpendicular to the axis of rotation of the platen 2. The rotary support shaft 110 is provided with a gear 112 which meshes with a gear 114 connected to a drive shaft of a head rotation motor 116. Thus, the print head 106 and the ink ribbon 100 are movable along the platen 2, and rotatable with respect to the axis of the platen 2.

With the head rotation motor 116 operated in opposite directions, the print head assembly 104 is rotated between its first angular position of FIGS. 5 and 6, and its second angular position of FIG. 7 which is angularly spaced from the first angular position by 180 degrees. When the print head assembly 104 is placed in its first angular position of FIGS. 5 and 6, the exposed part of the three-color ink ribbon 100 extends in a direction intersecting the print line (axis of the platen 2), and the yellow, magenta and cyan stripes Y, M and C are arranged in that order from right to left in FIG. 5. In other words, the color stripes Y, M and C are arranged so that the brightness of their colors is increased in the right direction (one of the opposite printing directions). In the first angular position, therefore, the yellow stripe Y leads the magenta stripe M, which in turn leads the cyan stripe C, when the print head 106 is moved in the right direction. This first angular position is selected when the printing is effected in the right direction.

When the printing takes place in the left direction (from right to left in FIG. 5), the print head assembly 104 is rotated by 180 degrees by the rotation motor 116 to its second angular position of FIG. 7 in which the exposed part of the three-color ink ribbon 100 extends in the same direction as in the first angular position, but is fed in the reverse direction. It will be obvious that the order of arrangement of the color stripes Y, M and C of the ink ribbon 100 in the second angular position, as viewed along the platen 2, is reversed with respect to that in the first angular position. Namely, the yellow, magenta and cyan stripes Y, M and C are arranged in that order from left to right. In this arrangement, the brightness of the color stripes of the ink ribbon 100 is decreased in the right direction, i.e., increased in the left direction (in the other printing direction).

As discussed above, the modified color printer of FIGS. 5–7 is provided with rotary means for rotating the print head assembly 104 between the first angular position for the right printing direction and the second angular position for the left printing direction. This modified embodiment is also adapted such that the color stripes of the ribbon 100 in opposition to the print wire rows 106*a*, 106*b*, 106*c* are disposed in the horizontal direction, in order of brightness or lightness of their colors, so that the brightness is increased in the currently selected printing direction.

It will be understood that the printing signals to activate the print wires of each row 106*a*, 106*b*, 106*c* for printing in the left direction should be converted to meet the inversion of the print head 106 from the first angular position to the second angular position. For example, the printing signal to activate the print wire at the top of the row 106*a* (in the first position of FIG. 6) for printing in the right printing direction should be converted to activate the print wire at the bottom of the row 106*a* (in the first position of FIG. 6) so that the converted signal activates the print wire which is actually located at the top of the inverted row with the print head 106 held in its second position of FIG. 7.

Although the above embodiment uses a three-color ribbon, it is possible to use a multi-color ribbon having more than three color stripes. In this case, the width of the ribbon and the angle of its exposed part relative to the print line may be suitably adjusted.

Further, it is possible to rotate the ribbon cassette 102 alone, rather than rotating it together with the print head 106. In this case, it is desired to rotate the ribbon cassette 102 by about 90 degrees in the counterclockwise direction from the first angular position of FIG. 6 to the second angular position, for easier support of the print head 106 on the carriage.

While the present invention has been described in its preferred embodiments, it is to be understood that the invention is not confined to the precise disclosure contained herein, but may be otherwise embodied with various changes, modifications and improvements which may occur to those skilled in the art, without departing from the spirit and scope of the invention defined in the appended claims.

What is claimed is:

1. A wire dot matrix impact color printer for effecting impression of images on a recording medium selectively in opposite directions along a print line, comprising:

at least three print head units of wire dot matrix type spaced from each other along said print line, and disposed in opposed relation with said recording medium;

at least three bi-color ribbons disposed to be fed between the corresponding print head units and said recording medium, each of said at least three bi-color ribbons having two transversely-spaced parallel longitudinal color stripes, said two color stripes of said at least three bi-color ribbons forming first and second arrays of at least three different colors which are equal in number to said at least three print head units and which have different values of lightness, said at least three different colors in said first array being arranged along said print line so that the lightness increases in one of said opposite printing directions, said at least three different colors in said second array being arranged along said print line so that the lightness increases in the other printing direction;

support and feed means for supporting said recording medium, said at least three bi-color ribbons and said at least three print head units, and for effecting a relative movement between an assembly of the bi-color ribbons and print head units and said recording medium in each of the opposite printing directions along the surface of the recording medium; and ribbon shift means for selectively positioning the color stripes of said first array into alignment with corresponding print head units when said one printing direction is selected, and for selectively positioning the color stripes of said second array into alignment with corresponding print head units when the other printing direction is selected;

whereby ink is deposited on the recording medium in an order extending from lightest to darkest in both printing directions.

2. A color printer according to claim 1, wherein said at least three bi-color ribbons consist of four bi-color ribbons, said color stripes of said first array having ink layers of black, cyan, magenta and yellow in that order in said one printing direction, said color stripes of said second array having ink layers of yellow, magenta, cyan and black in that order in said one printing direction which correspond to the ink layers of said first array.

3. A color printer according to claim 1, wherein said support and feed means comprises ribbon cassettes adapted to support said at least three bi-color ribbons for feeding thereof between the corresponding print head units and the recording medium, respectively, said ribbon shift means comprising carriers for supporting said ribbon cassettes pivotally about an axis parallel to said print line, and oscillator means for pivoting said carriers between a first position and a second position for selective alignment of said first and second arrays of color strips with the print head units.

4. A color printer according to claim 3, wherein said oscillator means includes biasing means for biasing said carriers toward one of said first and second positions, and electromagnet means for rotating the carriers to the other of the first and second positions against a biasing force of said biasing means.

5. A color printer according to claim 3, wherein said carriers consist of a single common support member for supporting all of said ribbon cassettes.

6. A color printer according to claim 1, wherein said support and feed means comprises a carriage which carries said at least three bi-color ribbons and said at least three print head units, and drive means for moving said carriage in said opposite printing directions along said print line.

7. A wire dot matrix impact color printer for effecting impression of images on a recording medium selectively in opposite directions along a print line, comprising:

a multi-color ribbon having at least three transversely-spaced parallel longitudinal color stripes of different colors having different values of lightness;

a plurality of print head units of wire dot matrix type equal in number and corresponding to said different colors of said color stripes of said ribbon, for transferring masses of inks from the respective color stripes to the surface of the recording medium;

support and feed means for supporting said recording medium, said multi-color ribbon and said print head units, and for effecting a relative movement between an assembly of said ribbon and print head units and said recording medium in each of the opposite printing directions along the surface of the recording medium, said support and feed means supporting said multicolor ribbon rotatably about an axis perpendicular to said print line to provide a first position in which the ribbon is fed in a first direction intersecting said print line and a second position angularly spaced from said first position and in which the ribbon is fed in a second direction intersecting said print line, said color stripes of the ribbon being disposed in opposed relation with said respective print head units such that the lightness of said color stripes increases in one of said opposite printing directions when said ribbon is placed in said first position, and further such that the lightness of said color stripes increases in the other printing direction when said ribbon is placed in said second position; and rotary switching means, associated with said support and feed means, for rotating said ribbon to said first position upon selection of said one of the opposite printing directions and to said second position upon selection of the other printing direction;

whereby ink is deposited on the recording medium in an order extending from lightest to darkest in both printing directions.

* * * * *